US009085132B2

(12) United States Patent
Kim et al.

(10) Patent No.: US 9,085,132 B2
(45) Date of Patent: Jul. 21, 2015

(54) REVERSE GRAVURE OFFSET PRINTING METHOD AND APPARATUS USING DISPOSABLE CLICHE

(75) Inventors: In Young Kim, Daejeon (KR); Taik Min Lee, Daejeon (KR); Jeong Dai Jo, Daejeon (KR); Dong-Soo Kim, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 127 days.

(21) Appl. No.: 13/533,061

(22) Filed: Jun. 26, 2012

(65) Prior Publication Data

US 2013/0008328 A1 Jan. 10, 2013

(30) Foreign Application Priority Data

Jul. 7, 2011 (KR) ..... 10-2011-0067433

(51) Int. Cl.

| | |
|---|---|
| ***B41F 3/36*** | (2006.01) |
| *B41F 13/193* | (2006.01) |
| *B41F 3/20* | (2006.01) |
| *B41F 3/16* | (2006.01) |

(52) U.S. Cl.

CPC ... *B41F 3/36* (2013.01); *B41F 3/16* (2013.01); *B41F 3/20* (2013.01); *B41F 13/193* (2013.01)

(58) Field of Classification Search

CPC ..... B41F 3/20; B41F 17/14
USPC ..... 101/41, 114, 150–170
See application file for complete search history.

(56) References Cited

U.S. PATENT DOCUMENTS

| | | | | |
|---|---|---|---|---|
| 2,543,013 | A * | 2/1951 | Glassey | 430/348 |
| 4,930,417 | A * | 6/1990 | Isobe | 101/465 |
| 5,653,167 | A | 8/1997 | De Volder | |
| 2006/0207446 | A1 | 9/2006 | Fischer et al. | |
| 2010/0139513 | A1 * | 6/2010 | Seong et al. | 101/252 |
| 2010/0164130 | A1 * | 7/2010 | Nara et al. | 264/37.1 |

FOREIGN PATENT DOCUMENTS

| | | |
|---|---|---|
| KR | 10-0975094 | 8/2010 |

* cited by examiner

*Primary Examiner* — Blake A Tankersley
*Assistant Examiner* — Quang X Nguyen
(74) *Attorney, Agent, or Firm* — Lexyoume IP Meister, PLLC

(57) ABSTRACT

Disclosed are a reverse gravure offset printing method and apparatus using a disposable cliche, which do not require cleaning of the cliche and do not require a large quantity of high-definition cliches because the cliche used in reverse gravure offset printing can be discarded after used once or several times and replaced with a new one, thereby achieving cost reduction.

3 Claims, 4 Drawing Sheets

REVERSE GRAVURE OFFSET PRINTING METHOD AND APPARATUS USING DISPOSABLE CLICHE

CROSS-REFERENCE TO RELATED APPLICATION

This application claims priority to and the benefit of Korean Patent Application No. 10-2011-0067433 filed in the Korean Intellectual Property Office on Jul. 7, 2011, the entire contents of which are incorporated herein by reference.

BACKGROUND OF THE INVENTION (a) Field of the Invention

The present invention relates to a reverse gravure offset printing method and apparatus, and more particularly, to a reverse gravure offset printing method and apparatus using a disposable cliche, which do not require cleaning of the cliche and do not require a large quantity of high-definition cliches because the cliche used in reverse gravure offset printing can be discarded after used once or several times and replaced with a new one, thereby achieving cost reduction.

(b) Description of the Related Art

In general, reverse gravure offset printing includes a base 120 applied with conductive ink I, a cliche CL, a roller 110, and a substrate 140, as shown in FIG. 2.

The roller 110 is brought into contact with the base 120 to transfer the conductive ink I from the base 120 to the roller 110.

Afterwards, the roller 110 is brought into contact with the cliche CL to peel off an unnecessary pattern I-2 on the roller 110 to the cliche CL, and then the roller 110 is brought into contact with the substrate 140 to set a necessary pattern I-1 on the substrate 140 (see FIG. 3 and FIG. 4)

The cliche L has a plurality of protrusions CL2. The protrusions CL2 are brought into contact with the roller 110 to transfer the unnecessary pattern I-2 to the protrusions CL2, as described above.

At this point, the conductive ink I is not transferred to recesses CL1 between the protrusions CL2. As a result, the necessary pattern I-1 remains on the roller 110.

The roller 110 carries out the above-described process while being rolled and moved by a roller driver 160.

This is well-known and disclosed in detail in Patented Invention No. 975,094, and hence a detailed description thereof will be omitted.

Unexplained reference numeral 150 denotes a table supporting the base 120 and the cliche CL.

However, the conventional reverse gravure offset printing has the following problems.

First, the cliche CL needs constant cleaning. As described above, the roller 110 is brought into contact with the cliche CL to peel off the unnecessary pattern I-2, during which the conductive ink, organic substances, alcohol, etc. remaining on the cliche CL have to be cleaned off.

However, cleaning of the cliche CL generates a large amount of waste solution, as well as requiring much effort and time.

Second, the printing process has to continue even during cleaning of the cliche CL, and hence it is necessary to prepare a large quantity of cliches CL in advance.

However, the above-described conventional cliche CL requires high definition and is made of metal, and therefore it costs a lot to prepare a large quantity of cliches CL in advance, as described above.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a reverse gravure offset printing method and apparatus using a disposable cliche, which do not require cleaning of the cliche and do not require a large quantity of high-definition cliches because the cliche used in reverse gravure offset printing can be discarded after used once or several times and replaced with a new one, thereby achieving cost reduction.

An exemplary embodiment of the present invention provides a reverse gravure offset printing apparatus using a disposable cliche, which peels off an unnecessary pattern on a roller by using a cliche and sets only a necessary pattern on a substrate, the apparatus including a cliche supply device disposed on one side of the reverse gravure offset printing apparatus and supplying the cliche, wherein the cliche supplied by the cliche supply device is used to peel off the unnecessary pattern from the roller and then the cliché is discharged.

The cliche supply device may include: an unwinder disposed on one side of the reverse gravure offset printing apparatus and unwinding a web on which the cliche is printed; a rewinder disposed on the opposite side of the unwinder and passing the web through the reverse gravure offset printing apparatus to wind the same; and an imprinting device disposed between the unwinder and the reverse gravure offset printing apparatus and causing the cliche to be printed on the web.

The imprinting device may include: a convex-concave roller forming the shape of the cliche by pressing one side of the web; and a pressure roller disposed on the opposite side of the web.

The convex-concave roller may be provided with heating means for heating the web.

The web may be made of thermoplastic resin.

Another embodiment of the present invention provides a reverse gravure offset printing method using a disposable cliche, the method including: the first step of applying conductive ink to a base; the second step of peeling off an unnecessary pattern on the roller by bringing a roller into contact with a cliche supplied by a cliche supply device; and the third step of bringing the roller into contact with a substrate to set a pattern remaining on the roller, wherein the cliche is discharged after peeling off an unnecessary pattern on the roller or after setting a pattern remaining on the roller.

According to the present invention explained above, the generation of a large amount of waste solution can be prevented because cleaning of the cliche is not required, and cost reduction can be achieved because there a large quantity of high-definition cliches is not required.

DETAILED DESCRIPTION OF THE EMBODIMENTS

Before explaining the current examples of the present modular outdoor playpen apparatus in detail, it is to be understood that the invention is not limited in its application to the details of construction and arrangements of the components set forth in the following description or illustration.

The invention is capable of other examples and of being practiced and carried out in various ways.

Also, it is to be understood that phraseology and terminology used herein with reference to device or element orientation (such as, for example, terms like "front", "back", "up", "down", "top", "bottom", "left", "lateral", and the like) are only used to simplify description of the present invention, and do not alone indicate or imply that the device or element referred to must have a particular orientation.

Hereinafter, an exemplary embodiment of the present invention will be described in detail with reference to the accompanying drawings. Prior to making the description, the terms or words used in the specification and claims of the present invention are not interpreted using typical or dictionary limited meanings, and are constructed as meanings and concepts conforming to the technical spirit of the present invention based on the principle that the inventors can appropriately define the concepts of the terms to explain the present invention in the best manner.

Accordingly, it is to be understood that the detailed description, which will be disclosed along with the accompanying drawings, is intended to describe the exemplary embodiments of the present invention and is not intended to represent all technical ideas of the present invention. Therefore, it should be understood that various equivalents and modifications can exist which can replace the embodiments described in the time of the application.

Figure 1:
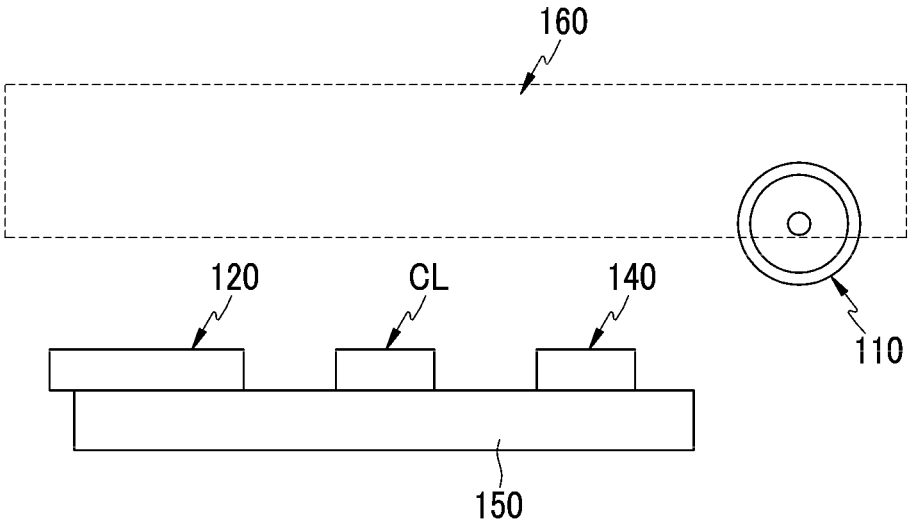
FIG.1 PRIOR ART
FIG. 1 and FIG. 2 are conceptual diagrams of a conventional reverse gravure offset printing apparatus.
Figure 2:
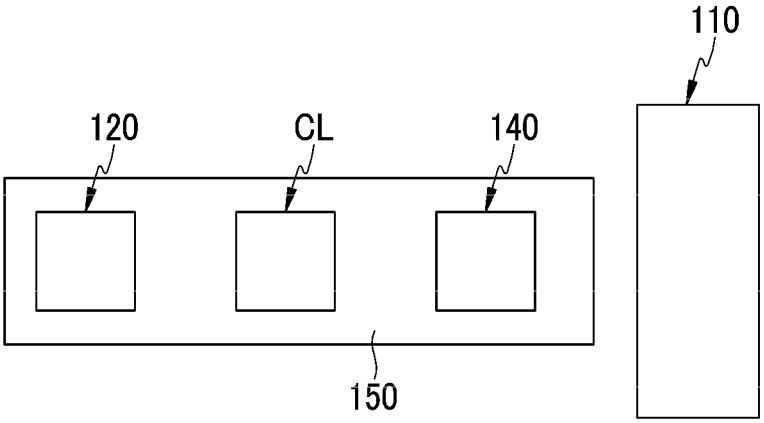
FIG.2 PRIOR ART
Figure 3:
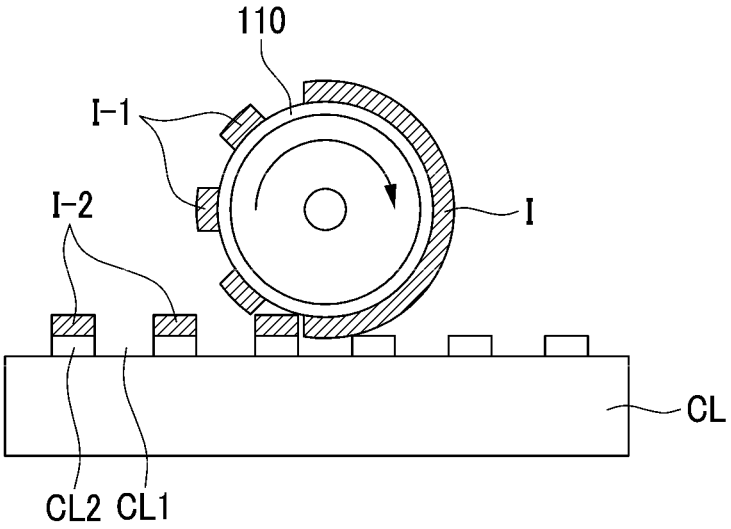
FIG.3 PRIOR ART
FIG. 3 and FIG. 4 are conceptual diagrams of a conventional reverse gravure offset printing method.
Figure 4:
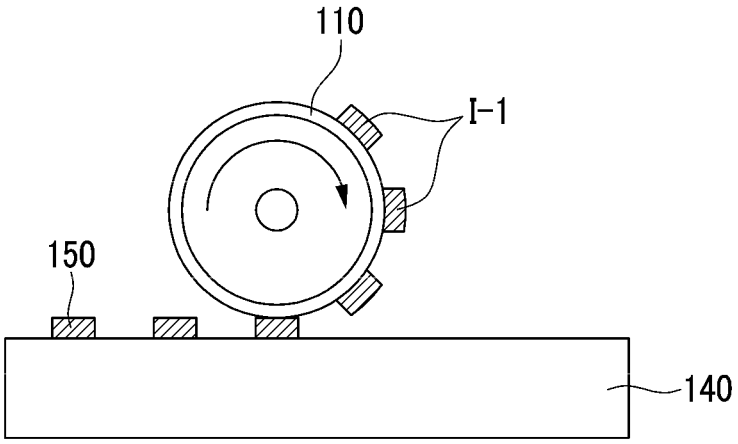
FIG.4 PRIOR ART
Figure 5:
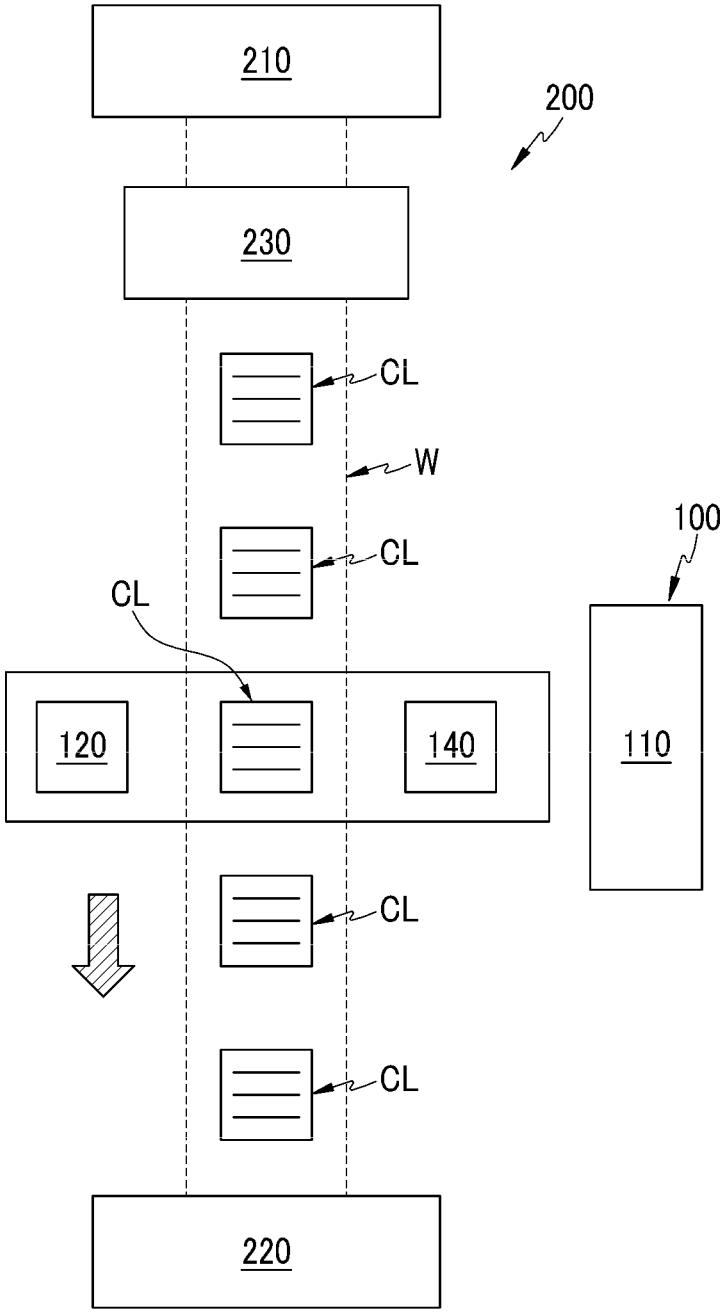
FIG. 5 is a conceptual diagram of a printing apparatus including a cliche supply device in accordance with the present invention.

Hereinafter, the present invention will be described in detail with reference to FIGS. 5 and 6 and an exemplary embodiment.

Exemplary Embodiment

The present invention involves a reverse gravure offset printing apparatus 100 which peels off an unnecessary pattern on a roller 110 by a cliche CL and sets only a necessary pattern on a substrate 140. The reverse gravure offset printing apparatus 100 further includes a cliche supply device 200 disposed on one side of the reverse gravure offset printing apparatus 100 and for supplying the cliche CL.

By using the cliche CL supplied by the cliche supply device 200, the unnecessary pattern is peeled off from the roller 110, and then the cliche CL is discharged.

That is, the cliche CL is discharged and discharged after the roller 110 and the cliche CL come into contact with each other a certain number of times, and then a new cliche CL is used. This means using a so-called disposable cliche CL, which is supplied by using the above-described cliche supply device 200.

Conventionally, a cliche made of an expensive metal was used, as described above, and a separate cleaning process was needed.

Accordingly, the conventional art has the problem that it takes much time and money because of the cliche cleaning process and a great deal of waste is generated during cleaning of the cliche.

In order to solve this problem, the present invention involves manufacturing the cliche to be disposable so that the cliche is discarded after used a certain number of times without the need of a separate cleaning process.

Moreover, significant cost reduction can be achieved by using a cheap cliche to be described later.

Meanwhile, the cliche supply device 200 may include an unwinder 210 disposed on one side of the reverse gravure offset printing apparatus 100 and unwinding a web W on which the cliche CL is printed, a rewinder 220 disposed on the opposite side of the unwinder 210 and passing the web W through the reverse gravure offset printing apparatus 100 to wind the same, and an imprinting device 230 disposed between the unwinder 210 and the reverse gravure offset printing apparatus 100 and causing the cliche CL to be printed on the web W.

That is, the unwinder 210 and the rewinder 220 are disposed in a vertical direction of the reverse gravure offset printing apparatus 100.

At this point, the web W is unwound from the unwinder 210 and wound on the rewinder 220, extending across the reverse gravure offset printing apparatus 100.

Meanwhile, the imprinting device 230 is disposed between the unwinder 210 and the reverse gravure offset printing apparatus 100, as described above, so that the cliche CL is printed on the web W.

By means of the thus-configured cliche supply device 200 of the present invention, the web W with the cliche CL formed thereon can be constantly supplied to the reverse gravure offset printing apparatus 100.

After using the cliche CL, the cliche CL can be discharged by operating the rewinder 220, and a new cliche CL can be put into use the rewinder 220. Consequently, the cliche CL can be used in a disposable manner.

As used herein, the term "disposable" is not limited to single use articles but also refers to articles that can be discarded after use.

The imprinting device 230 may include a convex-concave roller 231 forming the shape of the cliche CL and a pressure roller 232.

Figure 6:
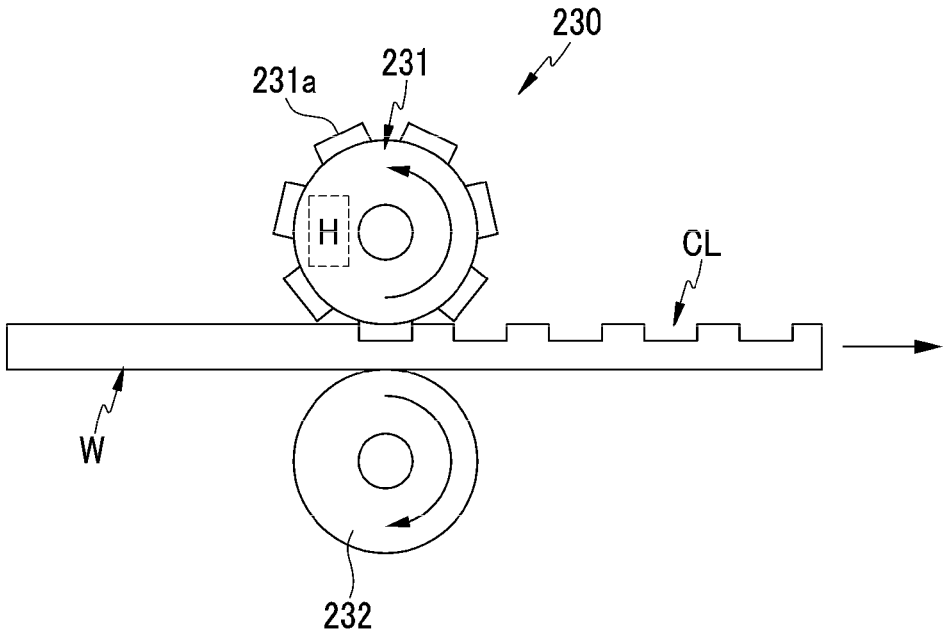
FIG. 6 is a conceptual diagram for explaining an imprinting device in accordance with the present invention.

As shown in FIG. 6, the convex-concave roller 231 may be disposed on one side of the web W, i.e., on an upper side of the web W, and the pressure roller 232 may be disposed on the opposite side of the web, i.e., on a lower side of the web W.

When the web W passes through the convex-concave roller 231 and the pressure roller 232, a convex-concave portion 231*a* of the convex-concave roller 231 presses the web W to form the cliche CL.

The convex-concave roller 231 may be provided with heating means H for heating the web W.

As described above, the web W is formed as it passes between the convex-concave roller 231 and the pressure roller 232, thereby heating the web W and making the formation of the web W easier.

For example, the heating means H may be disposed inside the convex-concave roller 231.

Or, other heating means (not shown) may be disposed outside the convex-concave roller 231.

A hot wire or the like may be used in the case that the heating means H is disposed inside the convex-concave roller 231, or a heating lamp or the like may be used in the case that the other heating means is disposed outside the convex-concave roller 231.

Needless to say, the heating means H may be disposed on the side of the pressure roller 232.

Meanwhile, the web W may be made of thermoplastic resin, thus forming the cliche CL more easily at lower costs.

The thermoplastic resin may include PMMA (polymethylmethacrylate).

Besides, the thermoplastic resin may include PC (Polycarbonate), PET (Polyethyleneterephthalate), PEN(Polyethylenernaphthalate, etc.

A typical reverse gravure offset printing apparatus other than the above-described is as explained above, so redundant explanation is omitted.

In what follows, a printing method S100 using the above-described reverse gravure offset printing apparatus 100 of the present invention will be explained.

First, the first step S110 of applying conductive ink I to the base 120 is carried out.

In the first step S110, conductive ink may be applied to the base 120 by spin coating or slit coating.

After carrying out the first step S110, the roller 110 is brought into contact with the cliche CL fed by the cliche supply device 200 to peel off an unnecessary pattern on the roller 110 is carried out.

The second step S120 may include the twenty-first step S121 of supplying the web W with the cliche CL formed thereon to the reverse gravure offset printing apparatus 100 and the twenty-second step S122 of peeling off an unnecessary pattern on the roller 110 by using the cliche CL on the supplied web W.

In the twenty-first step S121, the cliche CL is formed on the web W, supplied by the unwinder 210, by means of the imprinting device 230, and then supplied to the reverse gravure offset printing apparatus 100 by means of the rewinder 220.

That is, the cliche CL is formed on the web W by the imprinting device 230, and then the web W with the cliche CL formed thereon is fed to the printing apparatus 100.

Afterwards, as explained above, the roller 11 is brought into contact with the cliche CL to peel off an unnecessary pattern on the roller 110.

After carrying out the second step S120, the third step S130 of bringing the roller 110 into contact with the substrate 140 to set a pattern remaining on the roller 110, i.e., a desired printing pattern, on the substrate 140 is carried out.

The fourth step S140 of discharging the cliche CL may be carried out after an unnecessary pattern on the roller 110 is peeled off in the second step S120.

This is because the cliche CL is used in a disposable manner in the present invention.

Needless to say, the fourth step S140 of discharging the cliche CL may be carried out after a pattern remaining on the roller 110 is set on the substrate 140 in the third step S130.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of symbols> | |
|---|---|
| 100: reverse gravure offset printing apparatus | 110: roller |
| 120: base | CL: cliche |
| W: web | 140: substrate |

What is claimed is:

1. A reverse gravure offset printing apparatus using a disposable cliche, which peels off an unnecessary pattern on a roller by using the disposable cliche and sets only a necessary pattern on a substrate, the apparatus comprising:

a cliche supply device supplying the disposable cliché to the reverse gravure offset printing apparatus and comprising an unwinder disposed on one side of the reverse gravure offset printing apparatus and unwinding a web on which the disposable cliche is printed, a rewinder disposed on the opposite side of the unwinder and passing the web through the reverse gravure offset printing apparatus to wind the same, and an imprinting device disposed between the unwinder and the reverse gravure offset printing apparatus and causing the disposable cliche to be printed on the web, wherein the disposable cliche supplied by the cliche supply device is used to peel off the unnecessary pattern from the roller and then the disposable cliché is discharged, and wherein, the imprinting device comprises a convex-concave roller forming the shape of the disposable cliche by pressing one side of the web and a pressure roller disposed on the opposite side of the web, the web extends across a moving direction of the roller, the web is made of thermoplastic resin, and the convex-concave roller is provided with heating means for heating the web.

2. A reverse gravure offset printing method using the disposable cliché of claim 1, the method comprising:

applying conductive ink to a base;

peeling off an unnecessary pattern on the roller by bringing the roller into contact with the disposable cliche supplied by the cliche supply device; and bringing the roller into contact with a substrate to set a pattern remaining on the roller, wherein the disposable cliche is discharged after peeling off an unnecessary pattern on the roller or after setting a pattern remaining on the roller.

3. The method of claim 2, wherein the peeling off of an unnecessary pattern comprises:

supplying a web with the disposable cliche formed thereon to the reverse gravure offset printing apparatus using the disposable cliche; and peeling off an unnecessary pattern on the roller by using the disposable cliche on the supplied web, wherein, in the supplying of the web, the disposable cliche is formed on the web supplied by a unwinder by means of an imprinting device, and then supplied to the reverse gravure offset printing apparatus by means of a rewinder.

* * * * *